US010384212B2

(12) United States Patent
Chen et al.

(10) Patent No.: US 10,384,212 B2
(45) Date of Patent: Aug. 20, 2019

(54) POWDER MAKING DEVICE HAVING SPIKED HAMMER AND BLADE ARMS

(71) Applicant: SICHUAN YUWENTONG TECHNOLOGY CO., LTD, Mianzhu (CN)

(72) Inventors: Yong Chen, Mianzhu (CN); Zhenghui He, Mianzhu (CN)

(73) Assignee: SHENZHEN TONGYIKA TECHNOLOGY CO., LTD., Shenzhen, Guandong (CN)

( * ) Notice: Subject to any disclaimer, the term of this patent is extended or adjusted under 35 U.S.C. 154(b) by 0 days.

(21) Appl. No.: 15/927,259

(22) Filed: Mar. 21, 2018

(65) Prior Publication Data

US 2018/0207645 A1 Jul. 26, 2018

Related U.S. Application Data

(63) Continuation of application No. PCT/CN2016/099529, filed on Sep. 21, 2016.

(30) Foreign Application Priority Data

Sep. 22, 2015 (CN) ..... 2015 1 0604093

(51) Int. Cl.
*B01F 7/20* (2006.01)
*B02C 13/18* (2006.01)
(Continued)

(52) U.S. Cl.
CPC ..... *B02C 18/186* (2013.01); *B01F 7/00608* (2013.01); *B01F 7/00641* (2013.01);
(Continued)

(58) Field of Classification Search
CPC ..... B01F 7/22; B01F 7/00641; B01F 3/1221; B01F 7/162; B01F 7/00608;
(Continued)

(56) References Cited

U.S. PATENT DOCUMENTS 2,431,478 A * 11/1947 Hill ..... D06B 5/14 162/17
4,244,531 A 1/1981 Szegvari
(Continued)

FOREIGN PATENT DOCUMENTS

CN 2212449 Y 11/1995
CN 2564248 Y 8/2003
(Continued)

*Primary Examiner* — Charles Cooley
(74) *Attorney, Agent, or Firm* — Andrew C. Cheng

(57) ABSTRACT

An industrial powder making device having spiked hammer and blade arms. The device includes a powder making cylinder body, spiked hammer arms, a front oblique hammer, vertical hammers, a hammer arm, a detachable rack, a detachable rack inner bulge, spiked blade arms, a front oblique blade, high-hardness wear-resistant alloy sheets, a blade arm, a rotating shaft, a rotating shaft groove, a clamping piece, a feeding port, a discharging port, bearings, a rotating power module, a liquid nitrogen storage tank, a pipeline, a valve, nitrogen input holes, a nitrogen output hole, a fine particle collection device and a disc bevel discharging control device. An operating method is: crushing the ore by the spiked hammer arms, grinding the ore by the spiked blade arms, cooling with nitrogen, controlling equivalent input and output of the ore, and crushing and grinding the ore according to an established route, thereby realizing rapid powder making.

6 Claims, 5 Drawing Sheets

(51) Int. Cl.

| | |
|---|---|
| ***B02C 13/28*** | (2006.01) |
| ***B02C 17/16*** | (2006.01) |
| ***B02C 17/18*** | (2006.01) |
| ***B02C 17/24*** | (2006.01) |
| ***B02C 18/10*** | (2006.01) |
| ***B02C 18/18*** | (2006.01) |
| ***B02C 25/00*** | (2006.01) |
| ***B02C 13/286*** | (2006.01) |
| ***B01F 7/00*** | (2006.01) |

(52) U.S. Cl.
CPC ..... *B01F 7/20* (2013.01); *B02C 13/18* (2013.01); *B02C 13/2804* (2013.01); *B02C 17/16* (2013.01); *B02C 17/181* (2013.01); *B02C 17/1815* (2013.01); *B02C 18/10* (2013.01); *B02C 25/00* (2013.01); *B02C 17/183* (2013.01); *B02C 17/24* (2013.01); *B02C 2013/28609* (2013.01)

(58) Field of Classification Search
CPC ..... B01F 7/00633; B01F 7/18; B01F 7/20; H01M 4/04; H01M 4/0404; B02C 18/186; B02C 25/00; B02C 17/181; B02C 17/1815; B02C 13/18; B02C 13/28; B02C 18/18; B02C 18/10; B02C 17/16; B02C 17/24; B02C 17/183
USPC ..... 366/329.2
See application file for complete search history.

(56) References Cited

U.S. PATENT DOCUMENTS

| | | | | |
|---|---|---|---|---|
| 2012/0320705 | A1* | 12/2012 | Floan | B01F 7/00133 366/153.3 |
| 2018/0104660 | A1* | 4/2018 | Lei | B01F 7/00158 |
| 2018/0207645 | A1* | 7/2018 | Chen | B02C 13/18 |

FOREIGN PATENT DOCUMENTS

| | | | | |
|---|---|---|---|---|
| CN | 201231161 | Y | 5/2009 | |
| CN | 203329769 | U | 12/2013 | |
| CN | 204469835 | U | 7/2015 | |
| CN | 105080662 | A | 11/2015 | |
| CN | 205413189 | U | 8/2016 | |
| DE | 10132689 | A1 | 1/2003 | |
| EP | 1197474 | A1 * | 4/2002 | B01D 21/0018 |
| JP | H10824683 | U | 1/1996 | |
| JP | 1015376 | A | 1/1998 | |
| JP | 2012111685 | A * | 6/2012 | B01F 7/00125 |

* cited by examiner

POWDER MAKING DEVICE HAVING SPIKED HAMMER AND BLADE ARMS

TECHNICAL FIELD

The present invention relates to the field of industrial powder making, and particularly relates to a powder making device.

BACKGROUND

During existing industrial powder making, in order to obtain powder of more than 100 meshes, a powder making process is completed by milling ore of about 5 mm by a ball mill. Particles of about 5 mm are prepared by primary crushing, secondary crushing and fine crushing. The process of the ball mill consumes electricity, occupies places, needs more workers, generates high noise, has low productivity and many auxiliary devices, needs many supporting devices and huge investment, and pollutes the environment.

SUMMARY

With respect to defects in the prior art, the purpose of the present invention is to provide a powder making device with simple structure, high powder making efficiency and low energy consumption and without the need of water.

In order to achieve the above purpose, the present invention is realized by a technical solution as follows: a powder making device includes: a powder making cylinder body, a rotating shaft, a feeding port, a discharging port, bearings, a clamping piece and a rotating power module, as well as a powder making cylinder body, spiked hammer arms, a rotating shaft, a rotating shaft groove, a clamping piece, a feeding port, a discharging port, bearings and a rotating power module, wherein the powder making cylinder body is cylindrical, and centers of an upper part and a lower part of the powder making cylinder body are fixed by the bearings respectively; the rotating shaft penetrates through the two bearings and is connected with the rotating power module, and the rotating shaft groove is formed in the rotating shaft; the rotating power module is installed outside the powder making cylinder body and provides a rotating speed greater than 1000 revolutions per minute for the rotating shaft; the spiked hammer arms are composed of a front oblique hammer, vertical hammers, a hammer arm, a detachable rack and a detachable rack inner bulge; the front oblique hammer, the vertical hammers and the hammer arm are square; the front oblique hammer is a hammer which is obliquely fixed to an outer end of the hammer arm; the detachable rack is fixed to an inner end of the hammer arm; the hammer arm is narrow in exterior and wide in interior; the vertical hammers are uniformly fixed in the middle of the hammer arm, and a height of the spiked hammer arm takes a height of the front oblique hammer as the largest height and the height of the spiked hammer arm is gradually lowered from the front oblique hammer to the part connected to the detachable rack; the detachable rack is annular, and an inner circle of the detachable rack is matched with the rotating shaft; the detachable rack inner bulge is matched with the rotating shaft groove; the spiked hammer arms are superposed on the rotating shaft by virtue of the detachable rack, and the next spiked hammer arm is longer than an upper one; the clamping piece is used for fixing the spiked hammer arms superposed on the rotating shaft; and the feeding port and the discharging port are respectively formed in an upper part and a lower part of the powder making cylinder body.

Preferably, the quantity of the vertical hammers is more than one. The present invention has beneficial effects as follows: a traditional powder making mode is broken, and a traditional powder making process is overturned. The powder making device is low in cost, obvious in economic benefits, low in energy consumption, low in input, high in powder making efficiency, emission-reducing and environmental-friendly. The present invention is simple in structure, easy in operation, portable and small in occupied area and does not need water. The powder making device of the spiked hammer arm has the highest efficiency of grinding particles of 5 mm into particles less than 1 mm.

A powder making device includes: a powder making cylinder body, spiked blade arms, a rotating shaft, a clamping piece, a feeding port, a discharging port, bearings and a rotating power module as well as a powder making cylinder body, spiked blade arms, a rotating shaft, a rotating shaft groove, a clamping piece, a feeding port, a discharging port, bearings and a rotating power module, wherein the powder making cylinder body is cylindrical, and a bearing is fixed in each of centers of an upper part and a lower part of the powder making cylinder body; the rotating shaft penetrates through the two bearings and is connected with the rotating power module, and the rotating shaft groove is formed in the rotating shaft; the rotating power module is installed outside the powder making cylinder body and provides a rotating speed greater than 1000 revolutions per minute for the rotating shaft; the spiked blade arms are composed of a front oblique blade, a blade arm, a detachable rack and a detachable rack inner bulge; the front oblique blade and the blade arm are square; the front oblique blade is a blade which is obliquely fixed to an outer end of the blade arm; the detachable rack is fixed to an inner end of the blade arm; the blade arm is narrow in exterior and wide in interior; the vertical hammers are uniformly fixed in the middle of the blade arm, and a height of the spiked hammer arm takes a height of the front oblique blade as the largest height and the height of the spiked hammer arm is gradually lowered from the front oblique hammer to the part connected to the detachable rack; the detachable rack is annular, and an inner circle of the detachable rack is matched with the rotating shaft; the detachable rack inner bulge is matched with the rotating shaft groove; the spiked blade arms are superposed on the rotating shaft by virtue of the detachable rack, and the next spiked blade arm is longer than an upper one; the clamping piece is used for fixing the spiked blade arms superposed on the rotating shaft; the blade arm should rotate in the powder making cylinder body; a front side, an upper side and a lower side of a rotation direction of the blade arm are coated with high-hardness wear-resistant alloy sheets, and the front oblique blade is also coated with the high-hardness wear-resistant alloy sheets on three sides like the blade arm; and the feeding port and the discharging port are respectively formed in an upper part and a lower part of the powder making cylinder body.

Preferably, the quantity of the vertical hammers is more than one.

The present invention has beneficial effects as follows: besides the above beneficial effects, the powder making device of the spiked blade arm can crush the particles of 1 mm into fine powder of greater than 100 meshes, and the efficiency is highest.

A powder making device includes: a powder making cylinder body, spiked hammer arms, spiked blade arms, a rotating shaft groove, a clamping piece, a feeding port, a discharging port, bearings, a rotating power module, a liquid nitrogen storage tank, a pipeline, a valve, nitrogen input holes, a nitrogen output hole, a fine particle collection device, a discharging port, a feeding port and a disc bevel discharging control device, wherein the powder making cylinder body is cylindrical, and a bearing is fixed in each of centers of an upper part and a lower part of the powder making cylinder body; the rotating shaft penetrates through the two bearings and is connected with the rotating power module, and the rotating shaft groove is formed in the rotating shaft; the rotating power module is installed outside the powder making cylinder body and provides a rotating speed greater than 1000 revolutions per minute for the rotating shaft; the disc bevel discharging control device has a shape of a funnel; a lower round hole has an adjustable size, and the rotating shaft penetrates through the funnel-shaped lower round hole; the disc bevel discharging control device is installed in the powder making cylinder body, and the powder making cylinder body is divided into an upper part and a lower part; the spiked blade arms are composed of a front oblique blade, high-hardness wear-resistant alloy sheets, vertical hammers, a blade arm, a detachable rack and a detachable rack inner bulge; the front oblique blade and the blade arm are square; the front oblique blade is a blade which is obliquely fixed to an outer end of the blade arm; the detachable rack is fixed to an inner end of the blade arm; the blade arm is narrow in exterior and wide in interior; the vertical hammers are uniformly fixed in the middle of the blade arm, and a height of the spiked hammer arm takes a height of the front oblique blade as the largest height and the height of the spiked hammer arm is gradually lowered from the front oblique hammer to the part connected to the detachable rack; the detachable rack is annular, and an inner circle of the detachable rack is matched with the rotating shaft; the detachable rack inner bulge is matched with the rotating shaft groove; the spiked blade arms are superposed on the lower half part of the disc bevel discharging control device of the rotating shaft by virtue of the detachable rack, and the next spiked blade arm is longer than an upper one; the clamping piece is used for fixing the spiked blade arms superposed on the rotating shaft; the blade arm needs to rotate in the powder making cylinder body; a front side, an upper side and a lower side of a rotation direction of the blade arm are coated with high-hardness wear-resistant alloy sheets, and the front oblique blade is also coated with the high-hardness wear-resistant alloy sheets on three sides like the blade arm; the spiked hammer arms are composed of a front oblique hammer, vertical hammers, a hammer arm, a detachable rack and a detachable rack inner bulge; the front oblique hammer, the vertical hammers and the hammer arm are square; the front oblique hammer is a hammer which is obliquely fixed to an outer end of the hammer arm; the detachable rack is fixed to an inner end of the hammer arm; the hammer arm is narrow in exterior and wide in interior; the vertical hammers are uniformly fixed in the middle of the hammer arm, and a height of the spiked hammer arm takes a height of the front oblique hammer as the largest height and the height of the spiked hammer arm is gradually lowered from the front oblique hammer to the part connected to the detachable rack; the detachable rack is annular, and an inner circle of the detachable rack is matched with the rotating shaft; the detachable rack inner bulge is matched with the rotating shaft groove; the spiked hammer arms are superposed on the upper half part of the disc bevel discharging control device of the rotating shaft by virtue of the detachable rack, and the next spiked hammer arm is longer than an upper one; the clamping piece is used for fixing the spiked hammer arms superposed on the rotating shaft; the nitrogen input holes are uniformly distributed in the bottom of the powder making cylinder body; the liquid nitrogen storage tank, the pipeline and the valve provide an appropriate amount of low-temperature nitrogen for the powder making cylinder body by virtue of the nitrogen input holes; the nitrogen output hole is formed in the top of an upper powder making cylinder body and connected to the fine particle collection device; and the feeding port and the discharging port are respectively formed in an upper part and a lower part of the powder making cylinder body.

Preferably, the quantity of the vertical hammers is more than one. The present invention has beneficial effects as follows: besides the above beneficial effects, the particles of 5 mm may be directly milled into powder of greater than 100 meshes in one step by the powder making device in the present invention. If the device in the present invention is installed at a mine mouth, combined with the primary crushing, secondary crushing and fine crushing of the ore above, and jointly used with invented preparation equipment (with a patent certificate number of 2015204833546) described below, high-quality ore powder, and particularly fine iron ore concentrate, may be directly produced in a mine The present invention saves energy, does not need water, greatly alleviates environmental pollution pressure, greatly reduces production cost and brings obvious economic benefits.

Figure 1:
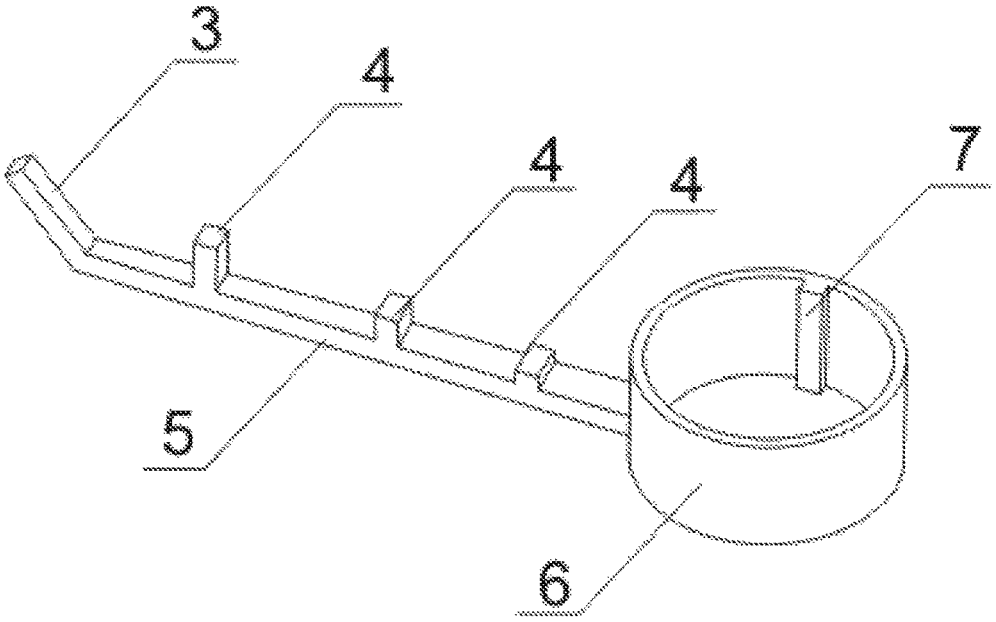
FIG. 1 is a schematic diagram of spiked hammer arms in the present invention.

In the figures: powder making cylinder body 1, spiked hammer arm 2, front oblique hammer 3, vertical hammer 4, hammer arm 5, detachable rack 6, detachable rack inner bulge 7, spiked blade arm 8, front oblique blade 9, high-hardness wear-resistant alloy sheet 10, blade arm 11, rotating shaft 12, rotating shaft groove 13, clamping piece 14, feeding port 15, discharging port 16, bearing 17, rotating power module 18, liquid nitrogen storage tank 19, pipeline 20, valve 21, nitrogen input hole 22, nitrogen output hole 23, fine particle collection device 24, and disc bevel discharging control device 25.

DETAILED DESCRIPTION

The present invention is described below in detail in combination with FIG. 1 to FIG. 5. Technical solutions in embodiments of the present invention are clearly and completely described. Apparently, the described embodiments are part of embodiments of the present invention only, rather than all the embodiments. Based on the embodiments in the present invention, all other embodiments obtained by those ordinary skilled in the art on premise of not making creative work should belong to a protection scope of the present invention.

Embodiment 1

Figure 2:
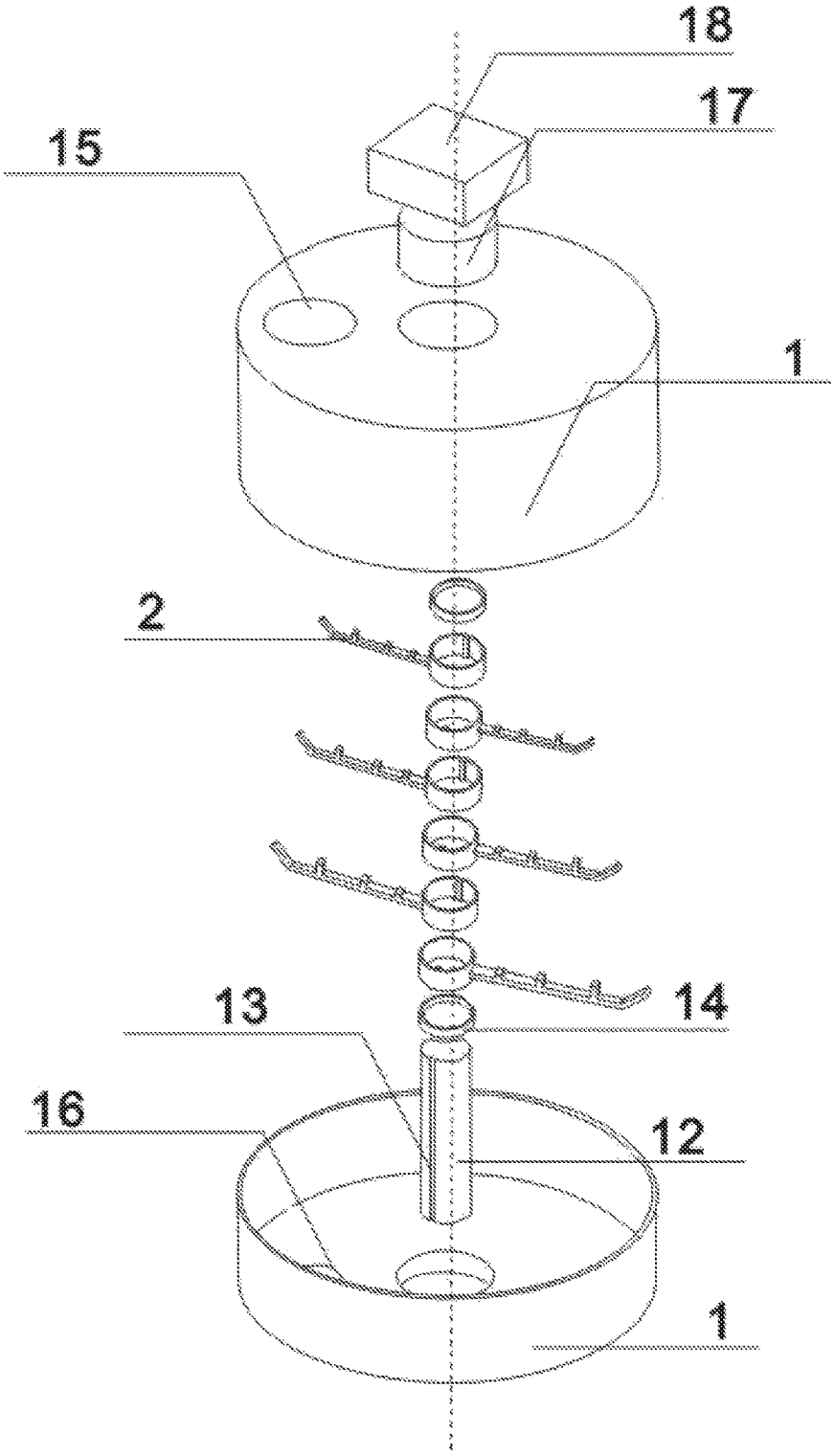
FIG. 2 is a structural exploded view of a powder making device composed of a group of spiked hammer arms in the present invention.

As shown in FIG. 1 and FIG. 2, the present invention is realized by a technical solution as follows: a powder making device includes: a powder making cylinder body (1), spiked hammer arms (2), a rotating shaft (12), a rotating shaft groove (13), a clamping piece (14), a feeding port (15), a discharging port (16), bearings (17) and a rotating power module (18).

The present embodiment is further configured as follows: the powder making cylinder body (1) is cylindrical, and centers of an upper part and a lower part of the powder making cylinder body are fixed by the bearings (17) respectively; the rotating shaft (12) penetrates through the two bearings and is connected with the rotating power module (18), and the rotating shaft groove (13) is formed in the rotating shaft (12); the rotating power module (18) is installed outside the powder making cylinder body (1) and provides a rotating speed greater than 1000 revolutions per minute for the rotating shaft (12); the spiked hammer arms (2) are composed of a front oblique hammer (3), vertical hammers (4), a hammer arm (5), a detachable rack (6) and a detachable rack inner bulge (7); the front oblique hammer (3), the vertical hammers (4) and the hammer arm (5) are square; the front oblique hammer (3) is a hammer which is obliquely fixed to an outer end of the hammer arm (5); the detachable rack (6) is fixed to an inner end of the hammer arm (5); the hammer arm (5) is narrow in exterior and wide in interior; the vertical hammers (4) are uniformly fixed in the middle of the hammer arm (5), and a height of the spiked hammer arm takes a height of the front oblique hammer (3) as the largest height and the height of the spiked hammer arm is gradually lowered from the front oblique hammer to the part connected to the detachable rack; the detachable rack (6) is annular, and an inner circle of the detachable rack (6) is matched with the rotating shaft (12); the detachable rack inner bulge (7) is matched with the rotating shaft groove (13); the spiked hammer arms (2) are superposed on the rotating shaft (12) by virtue of the detachable rack (6), and the next spiked hammer arm (2) is longer than an upper one; the clamping piece (14) is used for fixing the spiked hammer arms (2) superposed on the rotating shaft (12); and the feeding port (15) and the discharging port (16) are respectively formed in an upper part and a lower part of the powder making cylinder body.

The present embodiment is further configured as follows: the quantity of the vertical hammers is more than one.

An operating principle is as follows: particles of about 5 mm are uniformly poured in a central position from the feeding port, crushed by the spiked hammer arm which rotates at high speed and then crushed by the next spiked hammer arm which rotates at high speed, so that the particles are crushed into particles less than 1 mm layer by layer. If a particle size of the particles is not less than 1 mm, another high-speed rotating spiked hammer arm is added or the rotating speed is adjusted until the particles less than 1 mm are discharged from the discharging port. The quantity and rotating speed of the spiked hammer arms are properly adjusted so as to adapt to features of different ores, thereby ensuring that the particles less than 1 mm are discharged from the discharging port.

Embodiment 2

Figure 3:
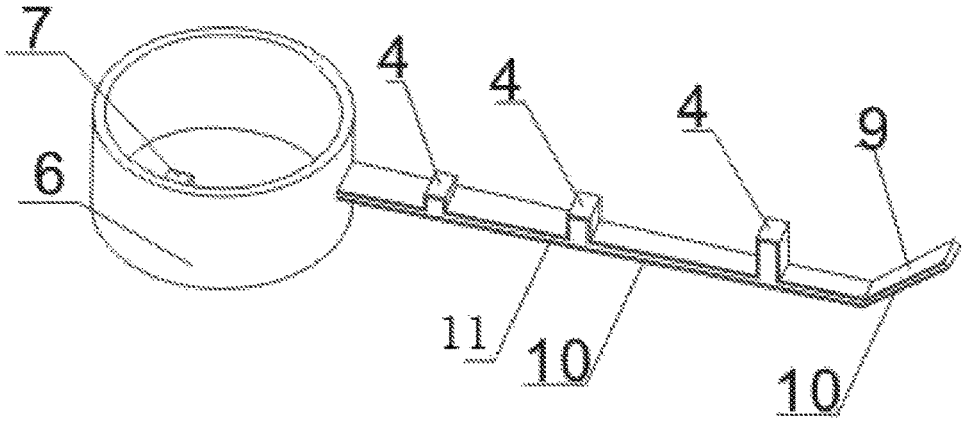
FIG. 3 is a schematic diagram of spiked blade arms in the present invention.
Figure 4:
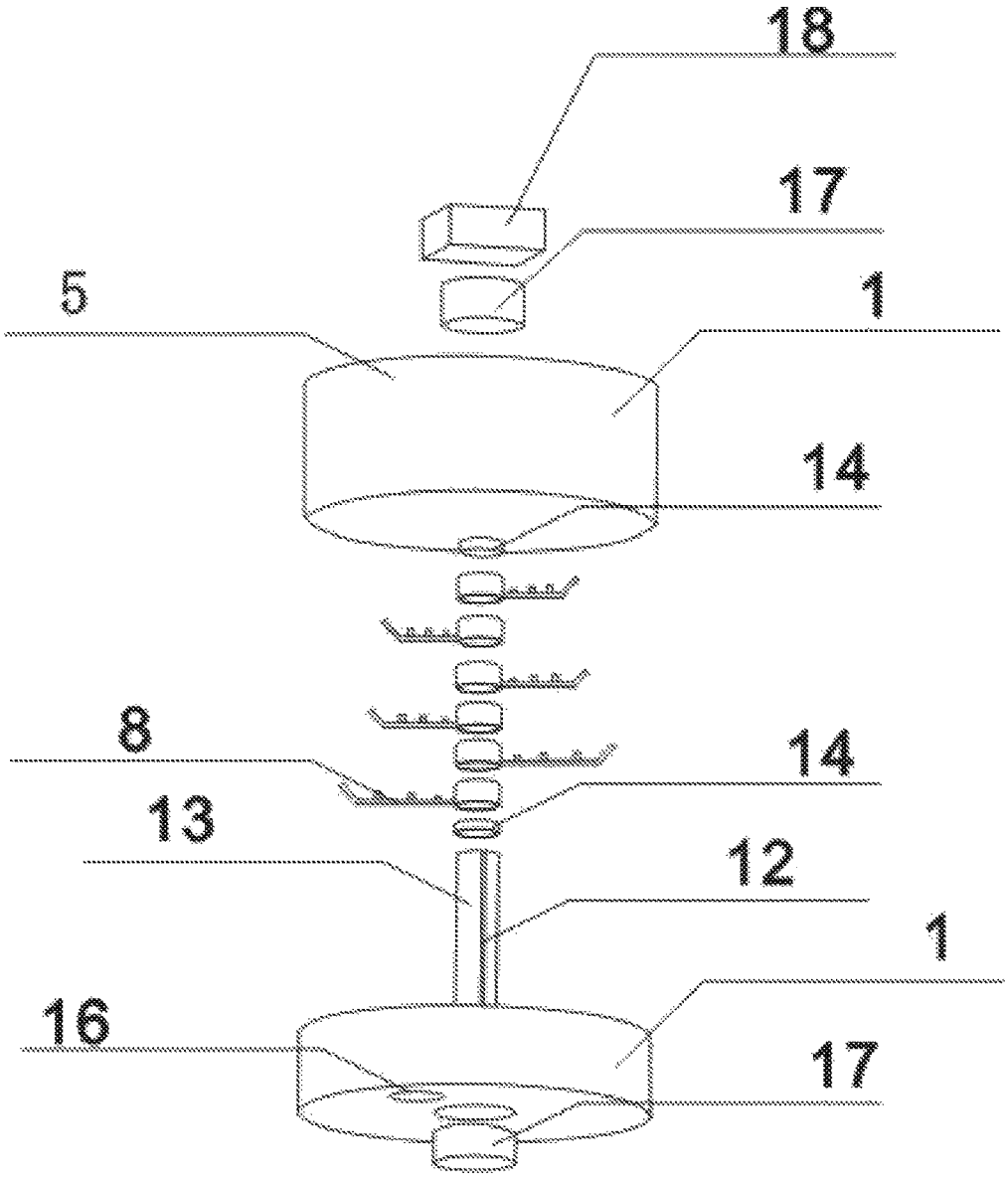
FIG. 4 is a structural exploded view of a powder making device composed of a group of spiked blade arms in the present invention.

As shown in FIG. 3 and FIG. 4, the present invention is realized by a technical solution as follows: a powder making device includes: a powder making cylinder body (1), spiked blade arms (8), a rotating shaft (12), a rotating shaft groove (13), a clamping piece (14), a feeding port (15), a discharging port (16), bearings (17) and a rotating power module (18).

The present embodiment is further configured as follows: the powder making cylinder body (1) is cylindrical, and centers of an upper part and a lower part of the powder making cylinder body are fixed by the bearings (17) respectively; the rotating shaft (12) penetrates through the two bearings and is connected with the rotating power module (18), and the rotating shaft groove (13) is formed in the rotating shaft (12); the rotating power module (18) is installed outside the powder making cylinder body (1) and provides a rotating speed greater than 1000 revolutions per minute for the rotating shaft (12); the spiked blade arms (8) are composed of a front oblique blade (9), vertical hammers (4), high-hardness wear-resistant alloy sheets (10), a blade arm (11), a detachable rack (6) and a detachable rack inner bulge (7); the front oblique blade (9) and the blade arm (11) are square; the front oblique blade (9) is a blade which is obliquely fixed to an outer end of the blade arm (11); the detachable rack (6) is fixed to an inner end of the blade arm (11); the blade arm (11) is narrow in exterior and wide in interior; the vertical hammers (4) are uniformly fixed in the middle of the blade arm (11), and a height of the spiked blade arm takes a height of the front oblique blade as the largest height and the height of the spiked blade arm is gradually lowered from the front oblique hammer to the part connected to the detachable rack; the detachable rack (6) is annular, and an inner circle of the detachable rack (6) is matched with the rotating shaft (12); the detachable rack inner bulge (7) is matched with the rotating shaft groove (13); the spiked blade arms (8) are superposed on the rotating shaft (12) by virtue of the detachable rack (6), and the next spiked blade arm (8) is longer than an upper one; the clamping piece (14) is used for fixing the spiked blade arms (8) superposed on the rotating shaft (12); the blade arm (11) needs to rotate in the powder making cylinder body; a front side, an upper side and a lower side of a rotation direction of the blade arm are coated with the high-hardness wear-resistant alloy sheets (10), and the front oblique blade (9) is also coated with the high-hardness wear-resistant alloy sheets (10) on three sides like the blade arm; and the feeding port (15) and the discharging port (16) are respectively formed in an upper part and a lower part of the powder making cylinder body (1).

The present embodiment is further configured as follows: the quantity of the vertical hammers is more than one.

An operating principle is as follows: ore particles less than 1 mm are uniformly fed in a central position from the feeding port, milled by the spiked blade arm which rotates at a high speed of 1000 revolutions per minute and milled by the next spiked blade arm which rotates at high speed, so that the particles are crushed into powder of greater than 100 meshes layer by layer. If a particle size of the fine powder is not greater than 100 meshes, another high-speed rotating spiked blade arm is added or a rotating speed is adjusted until the fine powder of greater than 100 meshes is discharged from the discharging port. The quantity and the rotating speed of the spiked blade arms are properly adjusted so as to adapt to features of different ores, thereby ensuring that the fine powder of greater than 100 meshes is discharged from the discharging port.

Embodiment 3

Figure 5:
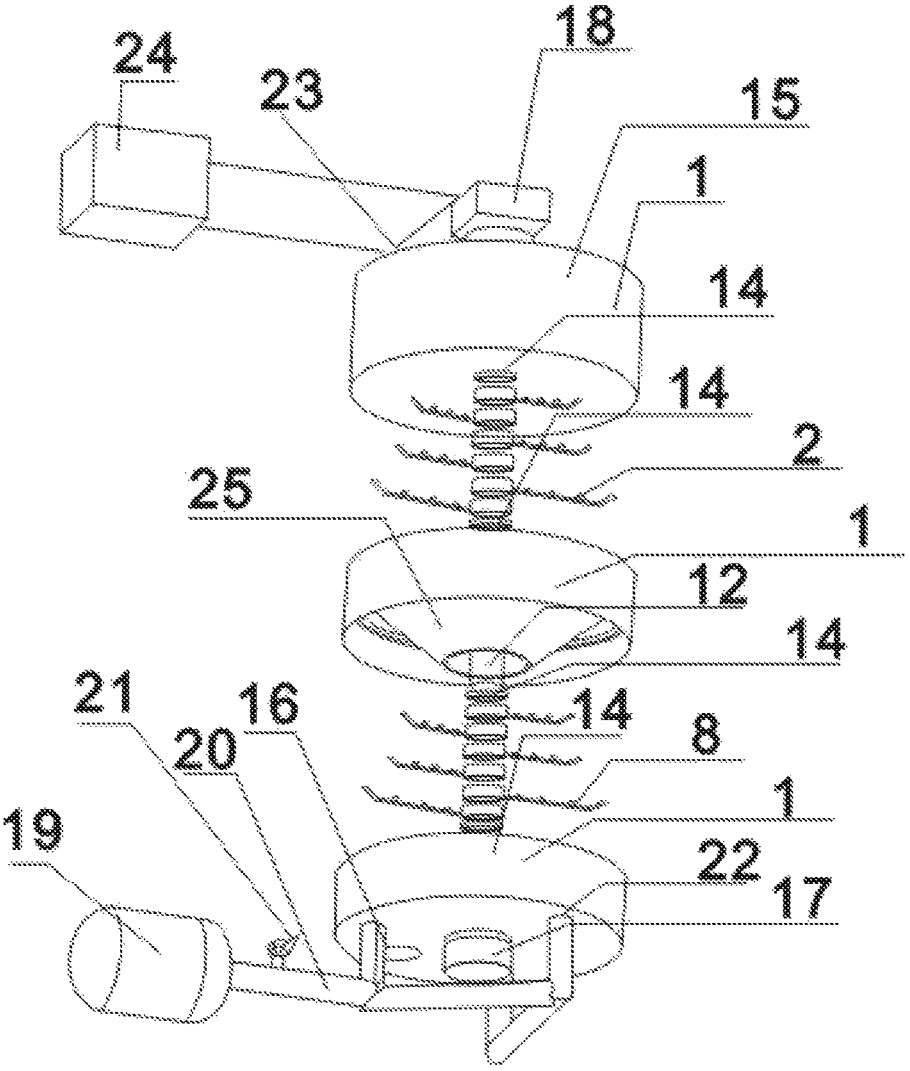
FIG. 5 is a structural exploded view of a powder making device composed of spiked hammer arms and spiked blade arms in the present invention.

As shown in FIG. 5, the present invention is realized by a technical solution as follows: a powder making device includes: a powder making cylinder body (1), spiked hammer arms (2), spiked blade arms (8), a rotating shaft (12), a rotating shaft groove (13), a clamping piece (14), a feeding port (15), a discharging port (16), bearings (17), a rotating power module (18), a liquid nitrogen storage tank (19), a pipeline (20), a valve (21), nitrogen input holes (22), a nitrogen output hole (23), a fine particle collection device (24) and a disc bevel discharging control device (25).

The present embodiment is further configured as follows: the powder making cylinder body (1) is cylindrical, and centers of an upper part and a lower part of the powder making cylinder body are fixed by the bearings (17) respectively; the rotating shaft (12) penetrates through the two bearings and is connected with the rotating power module (18), and the rotating shaft groove (13) is formed in the rotating shaft (12); the rotating power module (18) is installed outside the powder making cylinder body (1) and provides a rotating speed greater than 1000 revolutions per minute for the rotating shaft (12); the disc bevel discharging control device (25) has a shape of a funnel, a lower round hole has an adjustable size, and the rotating shaft (12) penetrates through the funnel-shaped lower round hole; the disc bevel discharging control device is installed in the powder making cylinder body (1), and the powder making cylinder body (1) is divided into an upper part and a lower part; the spiked blade arms (8) are composed of a front oblique blade (9), high-hardness wear-resistant alloy sheets (10), a blade arm (11), a detachable rack (6) and a detachable rack inner bulge (7); the front oblique blade (9) and the blade arm (11) are square; the front oblique blade (9) is a blade which is obliquely fixed to an outer end of the blade arm (11); the detachable rack (6) is fixed to an inner end of the blade arm (11); the blade arm (11) is narrow in exterior and wide in interior; the vertical hammers (4) are uniformly fixed in the middle of the blade arm (11), and a height of the spiked hammer arm takes a height of the front oblique blade as the largest height and the height of the spiked hammer arm is gradually lowered from the front oblique hammer to the part connected to the detachable rack; the detachable rack (6) is annular, and an inner circle of the detachable rack is matched with the rotating shaft (12); the detachable rack inner bulge (7) is matched with the rotating shaft groove (13); the spiked blade arms (8) are superposed on the lower half part of the disc bevel discharging control device (25) of the rotating shaft (12) by virtue of the detachable rack (6), and the next spiked blade arm (8) is longer than an upper one; the clamping piece (14) is used for fixing the spiked blade arms (8) superposed on the rotating shaft (12); the blade arm (11) needs to rotate in the powder making cylinder body; a front side, an upper side and a lower side of a rotation direction of the blade arm are coated with high-hardness wear-resistant alloy sheets (10), and the front oblique blade (9) is also coated with the high-hardness wear-resistant alloy sheets (10) on three sides like the blade arm (11); the spiked hammer arms (2) are composed of a front oblique hammer (3), vertical hammers (4), a hammer arm (5), a detachable rack (6) and a detachable rack inner bulge (7); the front oblique hammer (3), the vertical hammers (4) and the hammer arm (5) are square; the front oblique hammer (3) is a hammer which is obliquely fixed to an outer end of the hammer arm (5); the detachable rack (6) is fixed to an inner end of the hammer arm (5); the hammer arm (5) is narrow in exterior and wide in interior; the vertical hammers (4) are uniformly fixed in the middle of the hammer arm (5), and a height of the spiked hammer arm takes a height of the front oblique hammer (3) as the largest height and the height of the spiked hammer arm is gradually lowered from the front oblique hammer to the part connected to the detachable rack; the detachable rack (6) is annular, and an inner circle of the detachable rack is matched with the rotating shaft (12); the detachable rack inner bulge (7) is matched with the rotating shaft groove (13); the spiked hammer arms (2) are superposed on the upper half part of the disc bevel discharging control device (25) of the rotating shaft (12) by virtue of the detachable rack (6), and the next spiked hammer arm (2) is longer than an upper one; the clamping piece (14) is used for fixing the spiked hammer arms (2) superposed on the rotating shaft (12); the nitrogen input holes (22) are uniformly distributed in a bottom of the powder making cylinder body (1); the liquid nitrogen storage tank (19), the pipeline (20) and the valve (21) provide an appropriate amount of low-temperature nitrogen for the powder making cylinder body (1) by virtue of the nitrogen input holes (22); the nitrogen output hole (23) is formed in a top of an upper powder making cylinder body (1) and connected to the fine particle collection device (24); and the feeding port (15) and the discharging port (16) are respectively formed in an upper part and a lower part of the powder making cylinder body (1).

The present embodiment is further configured as follows: the quantity of the vertical hammers is more than one.

An operating principle is as follows: particles of about 5 mm are uniformly fed in the powder making cylinder body from the feeding port, crushed by the spiked hammer arm which rotates at a high speed greater than 1000 revolutions per minute and crushed by the next spiked hammer arm which rotates at high speed, so that the particles are crushed into particles less than 1 mm. If a particle size of the particles is not less than 1 min, another high-speed rotating spiked hammer arm is added or a rotating speed is adjusted until the particles less than 1 mm are discharged from the discharging port. The quantity and the rotating speed of the spiked hammer arms are properly adjusted so as to adapt to features of different ores. The disc bevel discharging control device is matched with a feeding control device to realize equivalent feeding and discharging; the particles less than 1 mm are dropped into the lower powder making cylinder body by virtue of the disc bevel discharging control device, milled by the spiked blade arm which rotates at high speed and then milled by another spiked blade arm which rotates at high speed, so that fine powder with granularity of greater than 100 meshes is obtained. If a particle size of the fine powder is not greater than 100 meshes, another high-speed rotating spiked blade arm is added or a rotating speed is adjusted until the fine powder of greater than 100 meshes is discharged from the discharging port. The quantity and the rotating speed of the spiked blade arms are properly adjusted so as to adapt to features of different ores, thereby ensuring that the fine powder of greater than 100 meshes is discharged from the discharging port The entire operation of rotating, crushing and milling is a high-heat process. The low-temperature nitrogen is inputted from the nitrogen input holes via the liquid nitrogen storage tank, the pipeline and the valve, and then a high temperature in the powder making cylinder body is decreased to an optimal powder making level. The nitrogen is eliminated from the nitrogen output hole on the upper part. The nitrogen eliminated from the nitrogen output hole is connected to the fine particle collection device, so as to collect fine ore particles taken out during nitrogen elimination.

The present invention is used in powder making. Actual verification effects are as follows:

I. iron ore:

1. particles: about 5 mm
2. spiked hammer arms: 8
3. spiked blade arms: 14
4. rotating speed: 3800 revolutions per minute 5. powder making fineness: greater than 100 meshes
6. yield: 5.12 tonnages per hour
II. river sand:
1. particles: about 5 mm
2. spiked hammer arms: 8
spiked blade arms: 12
4. rotating speed: 3800 revolutions per minute
5. powder making fineness: greater than 100 meshes
6. yield: 4.91 tonnages per hour Through the technical solutions in the present invention, similar technical solutions designed by those skilled in the art under inspiration of the technical solutions in the present invention and achieving the above technical solutions should be included in the protection scope of the present invention. A general principle defined in the present invention may be realized in other embodiments on premise of not deviating from the spirit or scope of the present invention. Therefore, the present invention is not limited to these embodiments illustrated in the present invention, but accords with the widest scope consistent with principles and novel characteristics disclosed in the present invention.

What is claimed is:

1. A powder making device having spiked hammer arms, comprising a powder making cylinder body, spiked hammer arms, a rotating shaft, a rotating shaft groove, a clamping piece, a feeding port, a discharging port, bearings and a rotating power module;

wherein the powder making cylinder body is cylindrical, and centers of an upper part and a lower part of the powder making cylinder body are fixed by the bearings respectively; the rotating shaft penetrates through the two bearings and is connected with the rotating power module, and the rotating shaft groove is formed in the rotating shaft; the rotating power module is installed outside the powder making cylinder body and provides a rotating speed greater than 1000 revolutions per minute for the rotating shaft; the spiked hammer arms are composed of a front oblique hammer, vertical hammers, a hammer arm, a detachable rack and a detachable rack inner bulge; the front oblique hammer, the vertical hammers and the hammer arm are square; the front oblique hammer is a hammer which is obliquely fixed to an outer end of the hammer arm; the detachable rack is fixed to an inner end of the hammer arm; the hammer arm is gradually narrowed from a part connected to the detachable rack to the front oblique hammer; the vertical hammers are uniformly fixed in the middle of the hammer arm, and a height of the spiked hammer arm takes a height of the front oblique hammer as the largest height and the height of the spiked hammer arm is gradually lowered from the front oblique hammer to the part connected to the detachable rack; the detachable rack is annular, and an inner circle of the detachable rack is matched with the rotating shaft; the detachable rack inner bulge is matched with the rotating shaft groove; the spiked hammer arms are superposed on the rotating shaft by virtue of the detachable rack; and a next adjacent spiked hammer arm is longer than an upper one of the next adjacent spiked hammer arm; the clamping piece is used for fixing the spiked hammer arms superposed on the rotating shaft; and the feeding port and the discharging port are respectively formed in an upper part and a lower part of the powder making cylinder body.

2. The powder making device having spiked hammer arms according to claim 1, wherein the quantity of the vertical hammers is more than one.

3. A powder making device having spiked blade arms, comprising a powder making cylinder body, spiked blade arms, a rotating shaft, a rotating shaft groove, a clamping piece, a feeding port, a discharging port, bearings and a rotating power module, wherein the powder making cylinder body is cylindrical, and centers of an upper part and a lower part of the powder making cylinder body are fixed by the bearings respectively; the rotating shaft penetrates through the two bearings and is connected with the rotating power module, and the rotating shaft groove is formed in the rotating shaft; the rotating power module is installed outside the powder making cylinder body and provides a rotating speed greater than 1000 revolutions per minute for the rotating shaft; the spiked blade arms are composed of a front oblique blade, vertical hammers, high-hardness wear-resistant alloy sheets, a blade arm, a detachable rack and a detachable rack inner bulge; the front oblique blade and the blade arm are square; the front oblique blade is a blade which is obliquely fixed to an outer end of the blade arm; the detachable rack is fixed to an inner end of the blade arm; the blade arm is gradually narrowed from a part connected to the detachable rack to the front oblique blade; the vertical hammers are uniformly fixed in the middle of the blade arm, and a height of the spiked blade arm takes a height of the front oblique blade as the largest height and the height of the spiked blade arm is gradually lowered from the front oblique blade to the part connected to the detachable rack; the detachable rack is annular, and an inner circle of the detachable rack is matched with the rotating shaft; the detachable rack inner bulge is matched with the rotating shaft groove; the spiked blade arms are superposed on the rotating shaft by virtue of the detachable rack, and the next adjacent spiked blade arm is longer than an upper one of the next adjacent blade arm; the clamping piece is used for fixing the spiked blade arms superposed on the rotating shaft; the blade arm rotates in the powder making cylinder body; a front side, an upper side and a lower side of a rotation direction of the blade arm are coated with the high-hardness wear-resistant alloy sheets, and the front oblique blade is also coated with the high-hardness wear-resistant alloy sheets on three sides like the blade arm; and the feeding port and the discharging port are respectively formed in an upper part and a lower part of the powder making cylinder body.

4. The powder making device having spiked blade arms according to claim 3, wherein the quantity of the vertical hammers is more than one.

5. A powder making device having spiked hammer arms and spiked blade arms, comprising a powder making cylinder body, spiked hammer arms, spiked blade arms, a rotating shaft, a rotating shaft groove, a clamping piece, a feeding port, a discharging port, bearings, a rotating power module, a liquid nitrogen storage tank, a pipeline, a valve, nitrogen input holes, a nitrogen output hole, a fine particle collection device and a disc bevel discharging control device, wherein the powder making cylinder body is cylindrical, and centers of an upper part and a lower part of the powder making cylinder body are fixed by the bearings respectively; the rotating shaft penetrates through the two bearings and is connected with the rotating power module, and the rotating shaft groove is formed in the rotating shaft; the rotating power module is installed outside the powder making cylinder body and provides a rotating speed greater than 1000 revolutions per minute for the rotating shaft the disc bevel discharging control device has a shape of a funnel, a lower round hole of the disc bevel discharging control device has an adjustable size, and the rotating shaft penetrates through the funnel-shaped lower round hole; the disc bevel discharging control device is installed in the powder making cylinder body, and the powder making cylinder body is divided into an upper part and a lower part; the spiked blade arms are composed of a front oblique blade, high-hardness wear-resistant alloy sheets, a blade arm, a detachable rack and a detachable rack inner bulge; the front oblique blade and the blade arm are square; the front oblique blade is a blade which is obliquely fixed to an outer end of the blade arm; the detachable rack is fixed to an inner end of the blade arm; the blade arm is gradually narrowed from a part connected to the detachable rack to the front oblique blade; vertical hammers are uniformly fixed in the middle of the blade arm, and a height of the spiked blade arm takes a height of the front oblique blade as the largest height and the height of the spiked blade arm is gradually lowered from the front oblique blade to the part connected to the detachable rack; the detachable rack is annular, and an inner circle of the detachable rack is matched with the rotating shaft; the detachable rack inner bulge is matched with the rotating shaft groove; the spiked blade arms are superposed on the lower half part of the disc bevel discharging control device of the rotating shaft by virtue of the detachable rack, and a next adjacent spiked blade arm is longer than an upper one of the next adjacent spiked blade arm; the clamping piece is used for fixing the spiked blade arms superposed on the rotating shaft; the blade arm rotates in the powder making cylinder body; a front side, an upper side and a lower side of a rotation direction of the blade arm are coated with high-hardness wear-resistant alloy sheets, and the front oblique blade is also coated with the high-hardness wear-resistant alloy sheets on three sides like the blade arm; the spiked hammer arms are composed of a front oblique hammer, vertical hammers, a hammer arm, a detachable rack and the detachable rack inner bulge; the front oblique hammer, the vertical hammers and the hammer arm are square; the front oblique hammer is a hammer which is obliquely fixed to an outer end of the hammer arm; the detachable rack is fixed to an inner end of the hammer arm; the hammer arm is gradually narrowed from a part connected to the detachable rack to the front oblique hammer; the vertical hammers are uniformly fixed in the middle of the hammer arm, and a height of the spiked hammer arm takes a height of the front oblique hammer as the largest height and the height of the spiked hammer arm is gradually lowered from the front oblique hammer to the part connected to the detachable rack; the detachable rack is annular, and an inner circle of the detachable rack is matched with the rotating shaft; the detachable rack inner bulge is matched with the rotating shaft groove; the spiked hammer arms are superposed on the upper half part of the disc bevel discharging control device of the rotating shaft by virtue of the detachable rack, and a next adjacent spiked hammer arm is longer than an upper one of the next adjacent spiked hammer arm; the clamping piece is used for fixing the spiked hammer arms superposed on the rotating shaft; the nitrogen input holes are uniformly distributed in a bottom of the powder making cylinder body; the liquid nitrogen storage tank, the pipeline and the valve provide an appropriate amount of low-temperature nitrogen for the powder making cylinder body by virtue of the nitrogen input holes; the nitrogen output hole is formed in a top of an upper powder making cylinder body and connected to the fine particle collection device; and the feeding port and the discharging port are respectively formed in an upper part and a lower part of the powder making cylinder body.

6. The powder making device having spiked hammer arms and spiked blade arms according to claim 5, wherein the quantity of the vertical hammers is more than one.

* * * * *